US008602324B2

(12) United States Patent
Kendall et al.

(10) Patent No.: US 8,602,324 B2
(45) Date of Patent: Dec. 10, 2013

(54) LIQUID SPRAYER

(75) Inventors: Jeffrey D. Kendall, Laurel, MD (US); David R. Axton, Port Byron, NY (US); Richard Sevrey, Bristol, IN (US); Fred A. Marconi, Erieville, NY (US)

(73) Assignee: Earthway Products, Inc., Bristol, IN (US)

( * ) Notice: Subject to any disclaimer, the term of this patent is extended or adjusted under 35 U.S.C. 154(b) by 464 days.

(21) Appl. No.: 12/876,585

(22) Filed: Sep. 7, 2010

(65) Prior Publication Data

US 2011/0042484 A1 Feb. 24, 2011

Related U.S. Application Data

(63) Continuation-in-part of application No. 12/633,166, filed on Dec. 8, 2009, now abandoned.

(60) Provisional application No. 61/120,997, filed on Dec. 9, 2008.

(51) Int. Cl.
*B05B 9/06* (2006.01)

(52) U.S. Cl.
USPC ..... 239/157; 418/16; 418/19; 239/146

(58) Field of Classification Search
USPC ..... 239/147, 155–158, 146, 47; 418/16, 19, 418/26, 152, 153, 156, 206.9
See application file for complete search history.

(56) References Cited

U.S. PATENT DOCUMENTS

| | | | | | |
|---|---|---|---|---|---|
| 2,491,818 | A | | 12/1949 | Lapp | |
| 2,699,122 | A | * | 1/1955 | Erickson | 418/196 |
| 2,721,437 | A | | 10/1955 | Greenlund | |
| 2,963,226 | A | | 12/1960 | Roque | |
| 2,975,940 | A | | 3/1961 | Nybakke | |
| 3,534,533 | A | | 10/1970 | Luoma | |
| 4,083,494 | A | | 4/1978 | Ballu | |
| 4,240,583 | A | * | 12/1980 | Hughes | 239/157 |
| 4,278,410 | A | * | 7/1981 | de Gaillard | 418/108 |
| 4,320,672 | A | * | 3/1982 | Segawa | 475/297 |

(Continued)

FOREIGN PATENT DOCUMENTS

| | | |
|---|---|---|
| CN | 201179487 | 2/2008 |
| JP | 2002059040 | 2/2002 |

OTHER PUBLICATIONS

"Spray Doc Wheel Pump 4 Gal", URL_http://www.skymall.com/shopping/detail.htm?pid+69622584&pnr=W22&cm_mmc=Is- -affilliate—Catalog- 69622584&pn=-W22&siteID=hLUPakqa5g4-sfHQZVSXPkVueGh4vL072g#moreinfo.

(Continued)

*Primary Examiner* — Jason Boeckmann

(74) *Attorney, Agent, or Firm* — Kegler Brown Hill & Ritter; James J. Pingor

(57) ABSTRACT

A motion-powered liquid sprayer that can increase the number of rotations of the pump relative to each rotation of the wheel or axle is provided. The sprayer can include a gearing assembly that employs gears to increase the number of pump revolutions as a function of the wheel or axle rotation. The sprayer can also include a gear pump that employs an over-capacity or enhanced gullet together with blow-by spacing to control consistent liquid flow relative to variable motional velocities. Further, the sprayer can include a vertically adjustable nozzle as well as a free reverse rotation wheel hub.

19 Claims, 18 Drawing Sheets

(56) References Cited

U.S. PATENT DOCUMENTS

| | | | | |
|---|---|---|---|---|
| 4,508,248 | A | | 4/1985 | Ridgeon |
| 4,714,196 | A | * | 12/1987 | McEachern et al. ..... 239/62 |
| 4,826,083 | A | | 5/1989 | Vanderjagt |
| 4,930,702 | A | | 6/1990 | Vanderjagt |
| 4,936,096 | A | | 6/1990 | Vanderjagt |
| 6,565,015 | B2 | | 5/2003 | Leer |
| 7,556,210 | B2 | | 7/2009 | Mandell |

OTHER PUBLICATIONS

"Acuspray", URL__http://www.techneat.co.uk/pdfs/Acuspray__flyer.pdf.

"Walkover Spray Unit", URL__http://www.allsun.com.au/Walkover.html.

"Wheel Spray", URL__http://www.wheelspray.com/ws__lit05.

* cited by examiner

LIQUID SPRAYER

CROSS-REFERENCE TO RELATED APPLICATIONS

This application is a Continuation-in-Part of pending U.S. patent application Ser. No. 12/633,166 entitled "LIQUID SPRAYER" and filed Dec. 8, 2009 which claims the benefit of U.S. Provisional Patent application Ser. No. 61/120,997 entitled "LIQUID SPRAYER" and filed Dec. 9, 2008. The entireties of the above-noted applications are incorporated by reference herein.

FIELD OF INVENTION

The invention relates generally to liquid sprayers and more particularly to liquid sprayers and associated pumping mechanisms that rely on the motion of the sprayer to distribute the liquid.

BACKGROUND

Today, a variety of conventional lawn spreaders and sprayers are available which are designed to spread fertilizers, insecticides, weed control chemicals, seed, etc. Accordingly, the industry offers an assortment of both dry particulate spreaders and liquid sprayers to professionals and homeowners alike. One problem with conventional walk-behind units is that they require a brisk but, constant gait so as to evenly distribute the desired treatment. Even, and controlled, dispense or distribute of chemicals and fertilizer is critical to the effectiveness as well as to the efficient use of the treatment. For example, a lawn can easily burn if treated with an over abundance of fertilizer.

Conventional motion-powered (e.g., walk-behind) liquid sprayers often incorporate a pump which is actuated by rotation of a wheel upon the axle of the sprayer. Thus, the wheel and axle are not only components for moving the sprayer along the terrain, they are also necessary components to the pump for dispensing the liquid. In many traditional sprayers, a 1:1 rotational ratio is employed between the wheel/axle rotation and the pump. In other words, for each rotation of the wheel or axle, the pump impeller completes a single revolution. As will be understood, this wheel-to-pump rotation performance requires the user to maintain an extremely rapid application pace so as to distribute an effective amount of liquid.

Additionally, conventional liquid spreaders are often equipped with off-the-shelf drill-pumps which are specifically designed for high-speed revolutions produced by an electric drill. Because they are designed for operation by a power drill, these pumps inherently generate a high amount of resistance which is transferred to the operator while pushing a motion-powered sprayer. Yet another drawback of using drill pumps is that the internal rubber impeller flaps or blades are often reversed in direction causing the pump to frictionally bind. For example, oftentimes, upon removing a liquid sprayer from a landscaping trailer, the wheels may hit the ground and inadvertently spin in a reverse direction. Because conventional liquid sprayers have a rigid drive mechanism designed for forward motion only, this reverse motion often causes the flaps to frictionally bind within the drill-pump. Thus, the operator experiences an additional amount of resistance in pushing the liquid sprayer until the flaps are repositioned in the correct orientation for forward motion.

For at least the reasons set forth above, the performance of liquid sprayers can be improved significantly.

SUMMARY

The following presents a simplified summary of the innovation in order to provide a basic understanding of some aspects of the innovation. This summary is not an extensive overview of the innovation. It is not intended to identify key/critical elements of the innovation or to delineate the scope of the innovation. Its sole purpose is to present some concepts of the innovation in a simplified form as a prelude to the more detailed description that is presented later.

The innovation disclosed and claimed herein, in one aspect thereof, comprises a motion-powered liquid sprayer that can increase the number of rotations of the pump relative to each rotation of the wheel or axle. By disassociating the strict rotational relationship between the wheels and the pump, a smaller pump can be used and/or larger wheels can be used to make the sprayer easier to move without sacrificing the volume of liquid distributed. Further, the liquid sprayer can be equipped with a self-agitation circulation mechanism so as to maintain or otherwise establish chemical mixture. A switch and valve mechanism can be employed to circulate liquid back into the vessel, for example in a "transport" or bypass mode.

Additionally, the sprayer can be adapted for a particular application or spray characteristic by changing the ratio of pump to wheel rotation. For example, a step-up gearing mechanism can be employed in communication with the axle and pump of a sprayer so as to alleviate resistance experienced by an operator while at the same time rotating the pump at a higher frequency relative to wheel rotation. Still further, in yet other aspects, a liquid gear pump can be employed that is capable of maintaining a consistent liquid output while alleviating the frictional binding characteristics of conventionally used drill pumps. The liquid gear pump can employ free-floating gears that include an oversized or over-capacity gullet. In addition to transferring fluid to the pump outlet, the gullet can be filled and emptied via either face of the gears. In other words, the free-floating gears can be encased within a cavity that enables blow-by through the non-engaged gear faces. This blow-by regulates output thereby enhancing consistency of pump output in response to variable motion velocities.

In yet other aspects, the pump can be equipped with chamber (or housing) that includes a mechanism by which flex of the chamber can be controlled thereby enhancing versatility and adjusting output of the pump. In one embodiment, a through-bolt can be employed to apply pressure upon an outer surface of the pump, thereby controlling an amount of flex of the chamber housing.

Still other aspects can employ a vertically adjustable spray nozzle. This adjustability can be employed to increase or decrease spray pattern width, for example, to accommodate edges or tight spaces. In addition to, or independent of, other functionality, a "pull back" free wheel hub may also be employed. The free wheel hub is designed to engage in a forward direction while effecting a free wheel hub when the wheel(s) is rotated in a reverse direction. Consistent with engagement, the sprayer can be equipped to discharge liquid when the hub is rotated in a forward direction. Similarly, when rotated in reverse direction, the discharge mechanisms of the sprayer are disengaged halting any liquid distribution.

To the accomplishment of the foregoing and related ends, certain illustrative aspects of the innovation are described herein in connection with the following description and the annexed drawings. These aspects are indicative, however, of but a few of the various ways in which the principles of the innovation can be employed and the subject innovation is intended to include all such aspects and their equivalents. Other advantages and novel features of the innovation will become apparent from the following detailed description of the innovation when considered in conjunction with the drawings.

DETAILED DESCRIPTION

Figure 1:
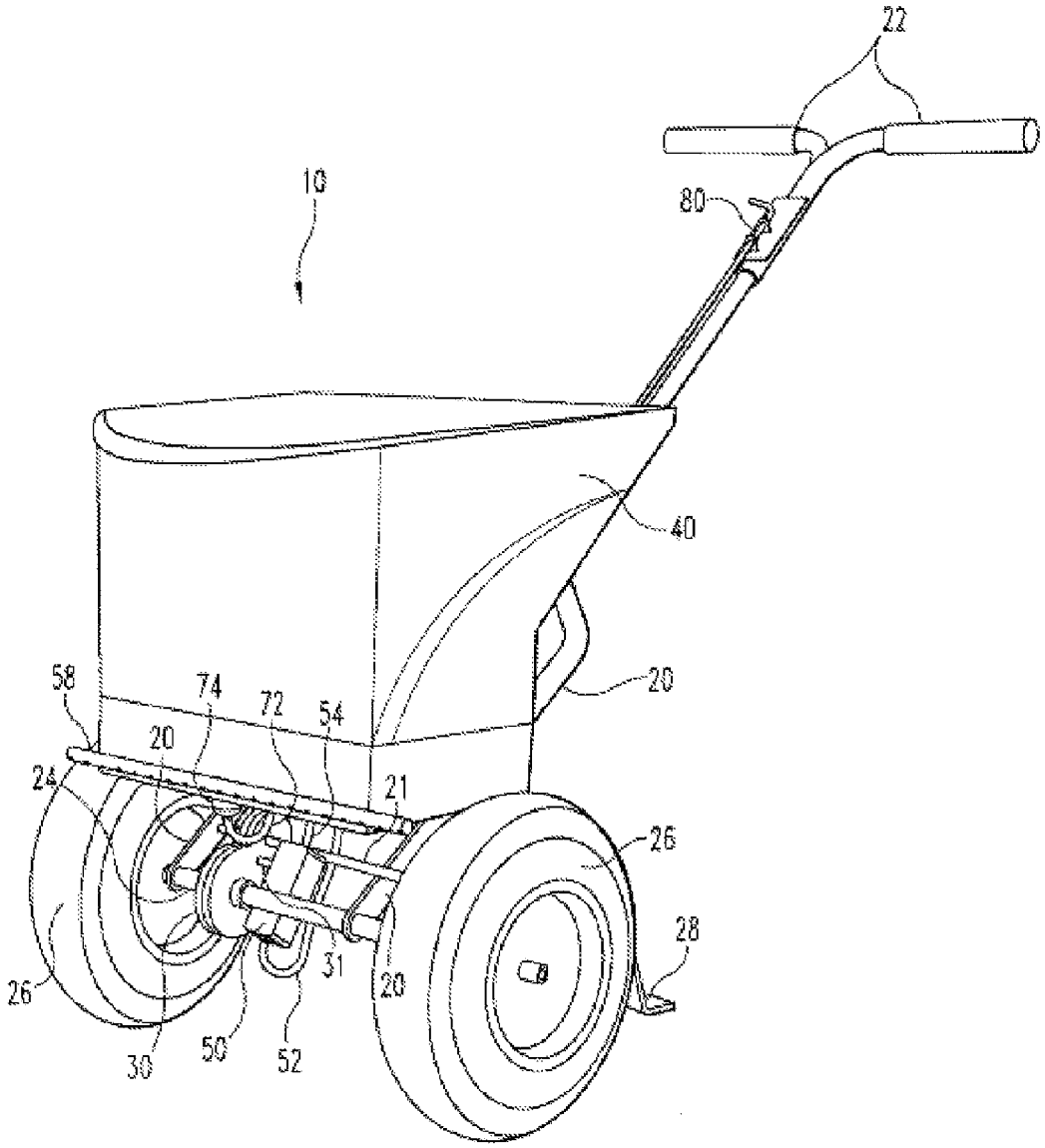
FIG. 1 illustrates a perspective view of an example liquid sprayer in accordance with an aspect of the innovation.

The innovation is now described with reference to the drawings, wherein like reference numerals are used to refer to like elements throughout. In the following description, for purposes of explanation, numerous specific details are set forth in order to provide a thorough understanding of the subject innovation. It may be evident, however, that the innovation can be practiced without these specific details.

For the purposes of promoting an understanding of the principles of the disclosure, reference will now be made to the embodiments illustrated and specific language will be used to describe the same. It will nevertheless be understood that no limitation of the scope of the disclosure is thereby intended, such alterations, modifications, and further applications of the principles of the disclosure being contemplated as would normally occur to one skilled in the art to which the disclosure relates.

Referring now to the drawings, FIG. 1 illustrates a perspective view of a liquid sprayer 10 in accordance with an aspect of the innovation. While the aspects described herein are directed to a liquid sprayer, it is to be understood that many of the features, functions and benefits described herein can also be applied to a broadcast spreader without departing from the spirit and/or scope of the innovation described and claimed herein.

Figure 4:
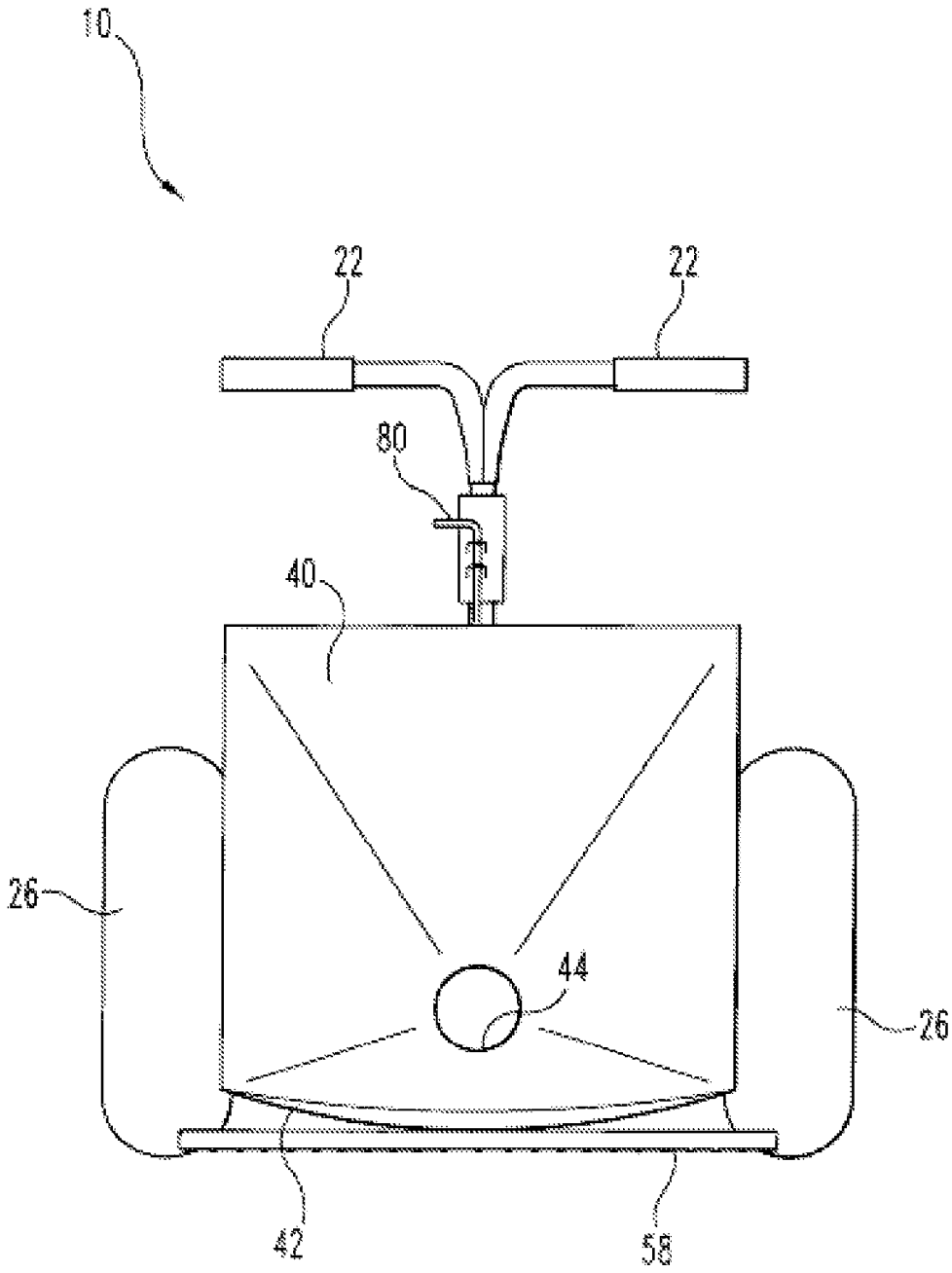
FIG. 4 illustrates a top view of an example liquid sprayer in accordance with an aspect of the innovation.

As shown in FIG. 1, the example liquid sprayer 10, includes a frame 20, optional handles 22, wheels 26, optional stand 28, and vessel or tank 40. While a specific embodiment is illustrated in FIG. 1, it is to be understood that alternative aspects and configurations exist without departing from the spirit and/or scope of the innovation. By way of example, alternative aspects can include a modified handle assembly 22 or an enclosed tank 40. For instance, the tank 40 can be designed with a lid having an opening for filling and/or emptying liquid. An example of an alternative design is illustrated in FIG. 4 described below.

An axle 24 extends from and is fixedly coupled to at least one of the wheels 26 and drives a gear assembly (not shown) housed within transfer case 30. As such, transfer case 30 can be positioned on axle 24 and may also be supported, as desired, upon a bar 21 engaged with frame 20. Although not shown in detail, it is to be appreciated that the axle 24 can be equipped with a bearing arrangement (not shown) that engages the gearing in one direction and not the other (e.g., forward but, not reverse). In this manner, the one-way bearing can drive a pump shaft when in forward motion. In reverse motion, the bearing can be free-wheeling and not engage the shaft. In one aspect, this bearing arrangement can be constructed of a bearing/cam arrangement which provides freedom of motion in one direction (e.g., reverse). When rotated in the other direction, the rollers and cam bind causing the axle to spin, thereby engaging the pump. It will be understood that this is but another aspect of the innovation and is not intended to limit the scope in any manner.

The gearing assembly housed within transfer case 30 can include a plurality of step-up gears capable of transmitting motion from one shaft to another while regulating or otherwise determining speed of the second shaft in relation to the first. In accordance with the sprayer, the first shaft is the axle 24 and the second is a pump shaft. As will be described infra, the pump can be a gear pump, a drill pump, or other suitably designed pump capable of transferring liquid from the tank to a distribution nozzle or mechanism. In one example, a 16:1 gearing ratio can be employed such that, for each rotation of the wheel 26, the pump rotates 16 times. It is to be understood that this ratio can be specifically designed to move sufficient liquid for a particular treatment application. Additionally, the gearing ratio and configuration can reduce operator effort and/or push resistance while maintaining effectiveness of the pump. It is to be understood that, other aspects can employ step-down gearing as appropriate or desired for a particular application.

Sprayer 10 includes a pump (not shown) enclosed within pump housing 50 positioned below the bottom of tank 40 and, as described above, operatively coupled with the gear assembly housed within case 30. In the illustrated embodiment, the pump is operatively coupled to the gear assembly within case 30 via shaft 31. However, it is to be appreciated that the pump can be arranged in a variety of other manners as would occur to one of ordinary skill in the art.

Additionally, in certain embodiments the pump may be designed to at least slightly pressurize the liquid received in the pump to allow for improved dispensing of the liquid from the sprayer 10. In this way, it will be appreciated that the liquid need not be pressurized within the tank 40. As will be described infra, the pump can be a gear pump specially designed to transfer liquid from tank 40 through a dispensing mechanism.

Figure 2:
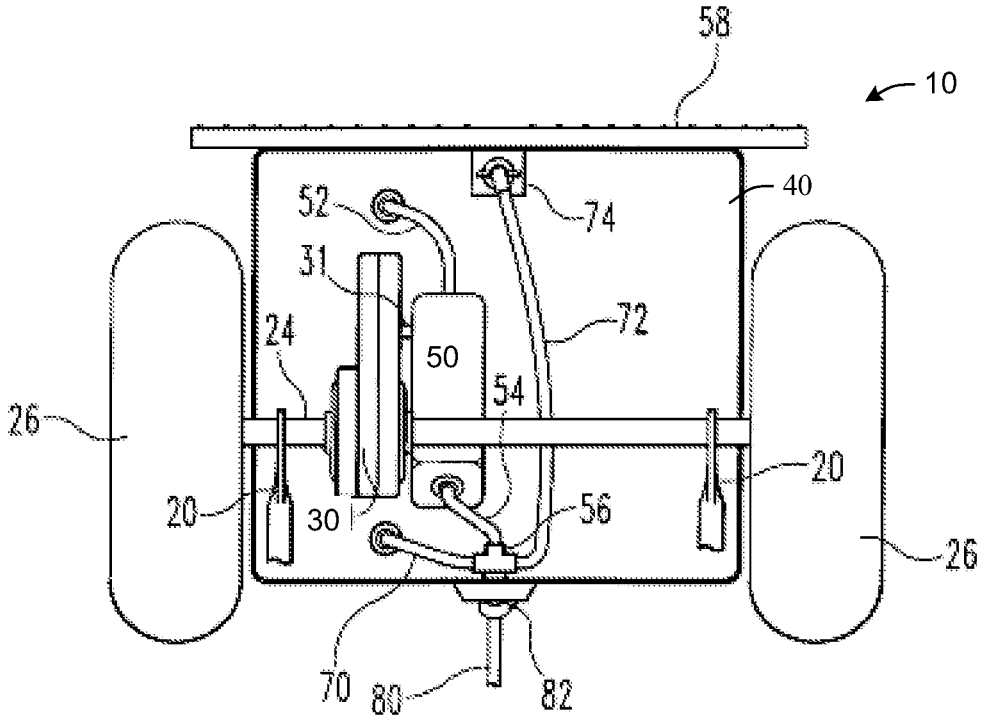
FIG. 2 illustrates a bottom view of an example liquid sprayer in accordance with an aspect of the innovation.

Referring now to FIG. 2, a passageway or an inlet line 52 connects the inlet (e.g., suction) side of the pump to the tank 40. The pump discharges through outlet line 54 to valve 56, which directs the discharged material (e.g., liquid) to either spray nozzle 74 via line 72 or back into tank 40 via tank return or passageway line 70. In operation, the return line, when the switching means is in bypass or "transport" mode, facilitates return of the liquid to vessel or tank 40. It will be appreciated that this return via line 70 can provide a means of agitation or mixing such that the sprayer need not include mechanical mixers as used by many conventional sprayers. Additionally, as will be understood in more detail upon a discussion of "blow-by" in the example gear pump, the return line 70 can provide a recycle means for liquid to alleviate, control or otherwise eliminate wasted liquid.

In operation, the direction of discharge from pump 50 may be controlled by a user of the sprayer 10. In other words, a user can control if liquid is externally dispensed or otherwise recycled back into vessel 40. Essentially, valve 56 can be employed to direct the fluid as desired.

Figure 3:
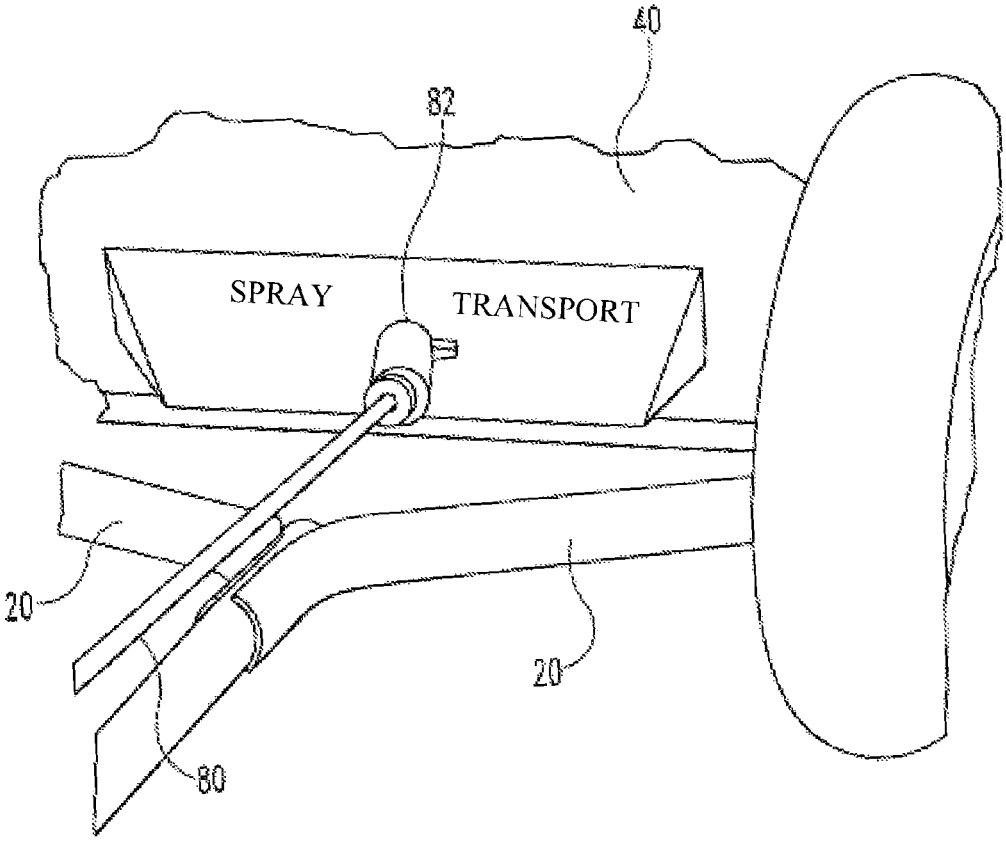
FIG. 3 illustrates a perspective view of an example mode selection section of an example sprayer in accordance with an aspect of the innovation.

As illustrated in FIG. 3, sprayer 100 can be equipped with a switching means having a handle 80 which a user may manipulate to move dial 82 between modes, for example, between "spray" and "transport" (or bypass) functions. In certain embodiments, handle 80 may be positioned adjacent to and/or engaged or coupled with frame 20. Dial 82 is operatively coupled with valve 56 (of FIG. 2) so as to direct the flow of the liquid discharge from the pump. The operative coupling between dial 82 and valve 56 may be configured in a variety of appropriate manners as would occur to one of ordinary skill in the art.

In one example, if the dial 82 is moved to the "spray" position, valve 56 will direct the discharge material entering from line 54 to nozzle 74 via line 72 as shown in and discussed with reference to FIG. 2. Otherwise, if the dial 82 is moved to the "transport" (or bypass) position, valve 56 will direct the discharge material entering from line 54 back into tank 40 via tank return line 70 to prevent the discharge material from dispensing out of the sprayer 10. As previously stated, by recycling liquid back into tank 40, the liquid can be naturally mixed or agitated so as to maintain sufficient mixture of chemicals or fluids.

It is to be understood that the arrangement of the components shown in the figures is for illustration purposes only. In other words, the illustrated examples are provided to add perspective to the innovation and are not intended to limit the innovation in any manner. Rather, it should be appreciated that the inclusion, sizing, placement, configuration and/or arrangement of the components within sprayer 10 may be varied without departing from the spirit and/or scope of the innovation and claims appended hereto. By way of example, in alternative embodiments, handle 80 and dial 82 may be absent, with the user being able to directly control the flow of liquid at valve 56 by other means such as a valve mounted switch, regulator or diverter (not shown).

With reference again to FIG. 2, a spray bar 58 may optionally be secured to the front of tank 40 and operatively coupled with nozzle 74. In this manner, the discharge material may be dispensed evenly out of spray bar 58. Although a particular spray bar 58 is illustrated, it should be appreciated that a variety of other manners of dispensing the liquid discharge material may be employed with the sprayer 10 as would occur to one of ordinary skill in the art. Additionally, in other embodiments, the liquid discharge material may be dispensed directly from nozzle 74.

FIG. 4 illustrates an overhead view of sprayer 100 in accordance with the described aspects. As shown, tank 40 can include a concave front portion along with an opening 44 that enables ease of filling and emptying the tank 40. The opening 44 can be equipped with a cap so as to prevent spillage or contamination of the liquid. The cap can be most any suitable cap mechanism including, but not limited to, a screw-on, snap-on, etc. capping mechanism. While a specific shape of tank 40 is illustrated in FIG. 4, it is to be understood that this alternative design is included to provide perspective to the innovation and not intended to limit the scope in any manner. Rather, the alternative design is provided to add additional features, functions and benefits to the innovation. For example, the concave design, together with the funnel-type impressions (illustrated by 4 solid lines in the cover 40) and opening 44, provides for added features of controlled filling and emptying of the tank 40. As well, contaminant (and splash) containment can be employed by enclosed tank 40 of FIG. 4.

As best illustrated in FIG. 4 and as stated above, to facilitate filling and emptying unused liquid, tank 40 may optionally include a contoured (e.g., concave) front portion 42 that is somewhat trough-like as it approaches opening 44. Unused liquid may be emptied from tank 40 by tilting the tank 40 forward. As such, the liquid can run along contour 42 and out opening 44. Tank 40 may optionally include a cap (not shown) to close off opening 44. It is to be understood that, in alternative embodiments, as illustrated in FIG. 1, tank 40 may have an open top.

Figure 5:
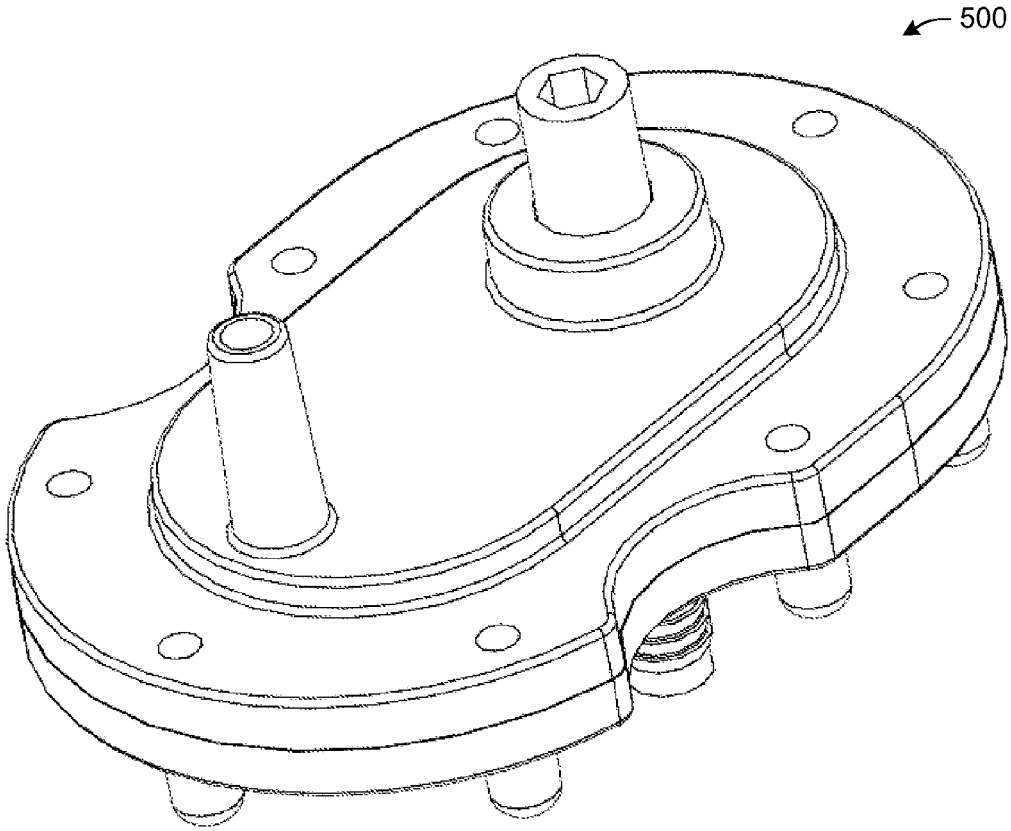
FIG. 5 illustrates a perspective view of an example gear pump that facilitates transfer of liquid in accordance with an aspect of the innovation.

Referring now to FIG. 5, an example pump 500 is shown. As will be shown and described in detail with regard to the figures that follow, pump 500 is a gear pump capable of maintaining a desired flow regardless of fluctuations in gait of an operator. As will be understood, the pump 500 is capable of producing enhanced pressure and volume flow with less effort as compared to traditional drill pump implementations.

Essentially, the gear pump 500 is specially engineered and designed to increase gullet size while allowing blow-by from the faces of the gears within the pump 500. It has been shown that the combination of these two design elements produces a desired amount of flow in liquid sprayer applications. Additionally, in accordance with the disclosed gear pump design, the amount of liquid dispensed between, for example, a two mile per hour (mph) walking pace and a two and one-half mph walking pace can be deemed negligible. While specific gearing ratios and dimensions may be described herein, it is to be understood that alternative aspects can be employed without departing from the spirit and/or scope of this disclosure and claims appended hereto.

As shown in FIGS. 1 and 2, pump housing 50 can be employed to encase or enclose the pump 500. As well, in other aspects, pump 500 can be exposed (e.g., without housing 50) to the elements. It will be appreciated that, in the aspects of the innovation, either pump 500, or alternatively a drill pump (not shown), can be employed with or without housing 50 as desired.

Returning to the embodiment of FIG. 5, the pump 500 is driven by rotation of axle 24 (see FIGS. 1 and 2). Axle 24 can be linked to pump 500 through a gearing mechanism encased within case 30. With reference again to FIG. 2, in certain embodiments, at least two gears are operatively coupled or engaged (within case 30) with each other between axle 24 and pump 500 (encased within housing 50). It will be appreciated that, the gearing ratio can be specifically designed based upon a number of factors including, but not limited to, pump (e.g., pump 500) design as well as a desired operator push resistance. In other words, the gearing ratio can be designed to produce (or otherwise limit) a desired speed, torque or direction of motion as required or desired. While spur gears are described, it is to be understood that the novel gearing mechanism can employ most any gear type including, but not limited to, helical gears, bevel gears, worm gears, etc. or combinations thereof.

With continued discussion of the gearing mechanism housed within case 30, in certain other embodiments, at least three gears (e.g., spur gears) are operatively coupled with each other between axle 24 and pump 500. In yet other embodiments, four or more gears may be operatively coupled with each other between axle 24 and pump 500. As described with regard to pump housing 50, in alternative embodiments, case 30 may be absent, with the gear assembly being exposed.

By way of example, the ratio between the gears can be chosen based on the pump capacity, wheel diameter (or circumference), desired push resistance, and/or desired volume of liquid to be distributed. For instance, if the sprayer travels one foot per wheel 26 revolution, the spray bar 58 distributes liquid across a width of one foot, the pump 500 discharges 0.0005 gal per rotation, and the desired distribution of the liquid is 0.001 gallons per square foot, the gear ratio should be two, such that each rotation of the wheel 26 will rotate the pump 500 twice distributing 0.0005 gallons over a one square foot area (one foot wide path by one foot of travel per rotation of the wheel 26).

It will be understood that, by modifying the gearing ratio, a smaller pump may be used to provide the same or substantially similar distribution. For example, using the example above, if the pump 500 discharges 0.00025 gallons per rotation, the gear ratio within case 30 is four. For every rotation of a first gear, a second gear should rotate twice for the pump 500 to distribute the desired 0.0005 gallons (two rotations× 0.00025 gallons/rotation) for each foot the sprayer travels. If larger wheels 26 are used, for example to make the sprayer easier to push, the gear ratio may be changed so that the pump 500 distributes sufficient liquid along the path of the sprayer to provide the desired coverage.

Because, in one aspect, the axle 24 and the pump 500 are linked through gears, it will be understood that rotation of axle 24 rotates the gearing mechanisms which ultimately rotates the gears of pump 500. It will be appreciated that other aspects can employ a gear pump 500 as described, with or without, gearing mechanisms within housing 30. As described with regard to FIG. 3, to cease or postpone distribution of liquid, the dial 82 may be moved to the "transport" position. Thus, valve 56 will direct the liquid discharge material entering from line 54 back into tank 40 via tank return line 70.

Therefore, when axle 24 rotates and thereby drives pump 500, the pump 500 provides flow to circulate liquid back into the tank 40 rather than to nozzle 74, or optionally spay bar 58. To distribute liquid again, the dial 82 may be moved to the "spray" position so that valve 56 will direct the liquid discharge material entering from line 54 to nozzle 74 for the appropriate dispensing mechanism (e.g., nozzle, spray bar).

Figure 6:
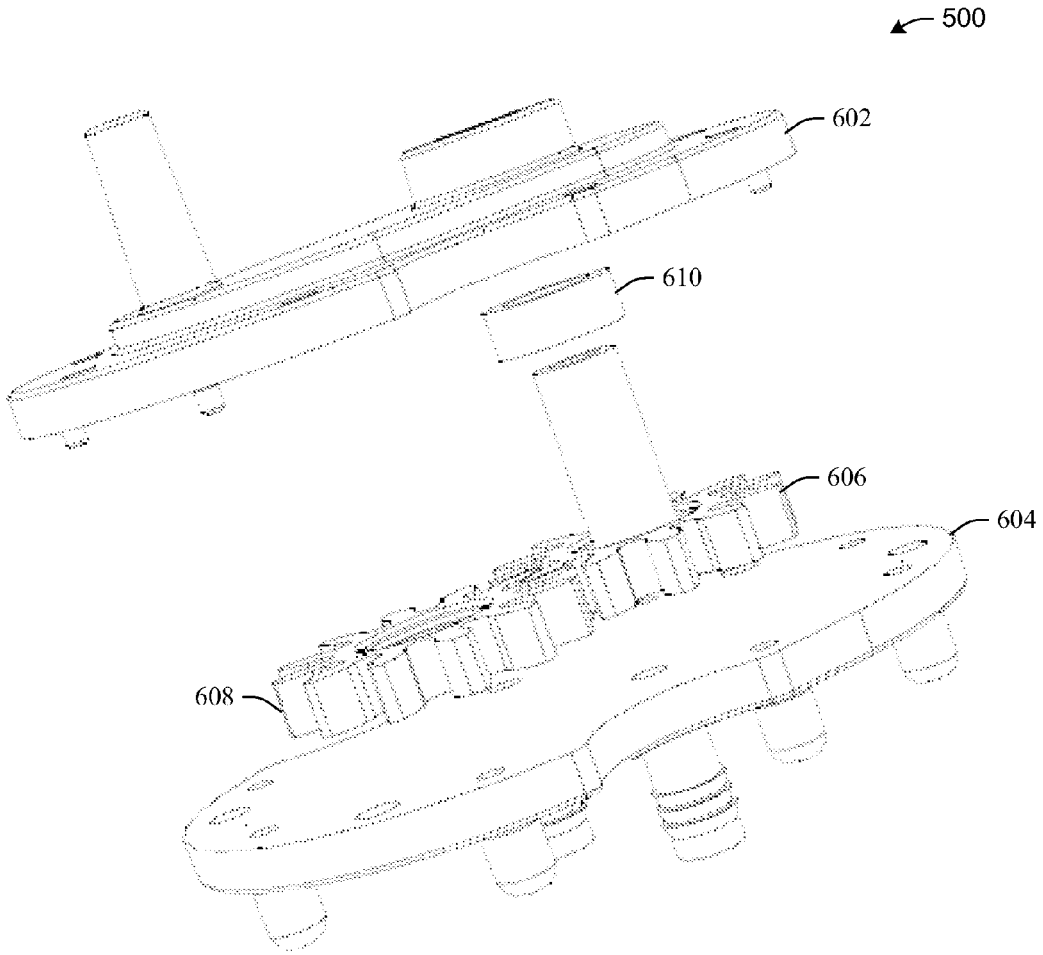
FIG. 6 illustrates an exploded view of an example gear pump in accordance with aspects of the innovation.

FIG. 6 illustrates an exploded view of pump 500. As shown, pump 500 can include a split housing assembly constructed of a top portion 602 and a bottom portion 604. Each of these housing portions (602, 604) will be described in greater detail with regard to FIGS. 7 and 8 respectively. As illustrated, the housing portions (602, 604) encase two gears (606, 608) and a cup seal 610. It is to be appreciated that gears 606, 608 are free floating within the housing (602, 604). The cup seal (or spacer) 610 can be provided to align gear 606 within top portion 602. It will be understood that alternative aspects can be employed without seal 610. These alternative aspects are to be included within the scope of this disclosure and claims appended hereto.

Figure 7:
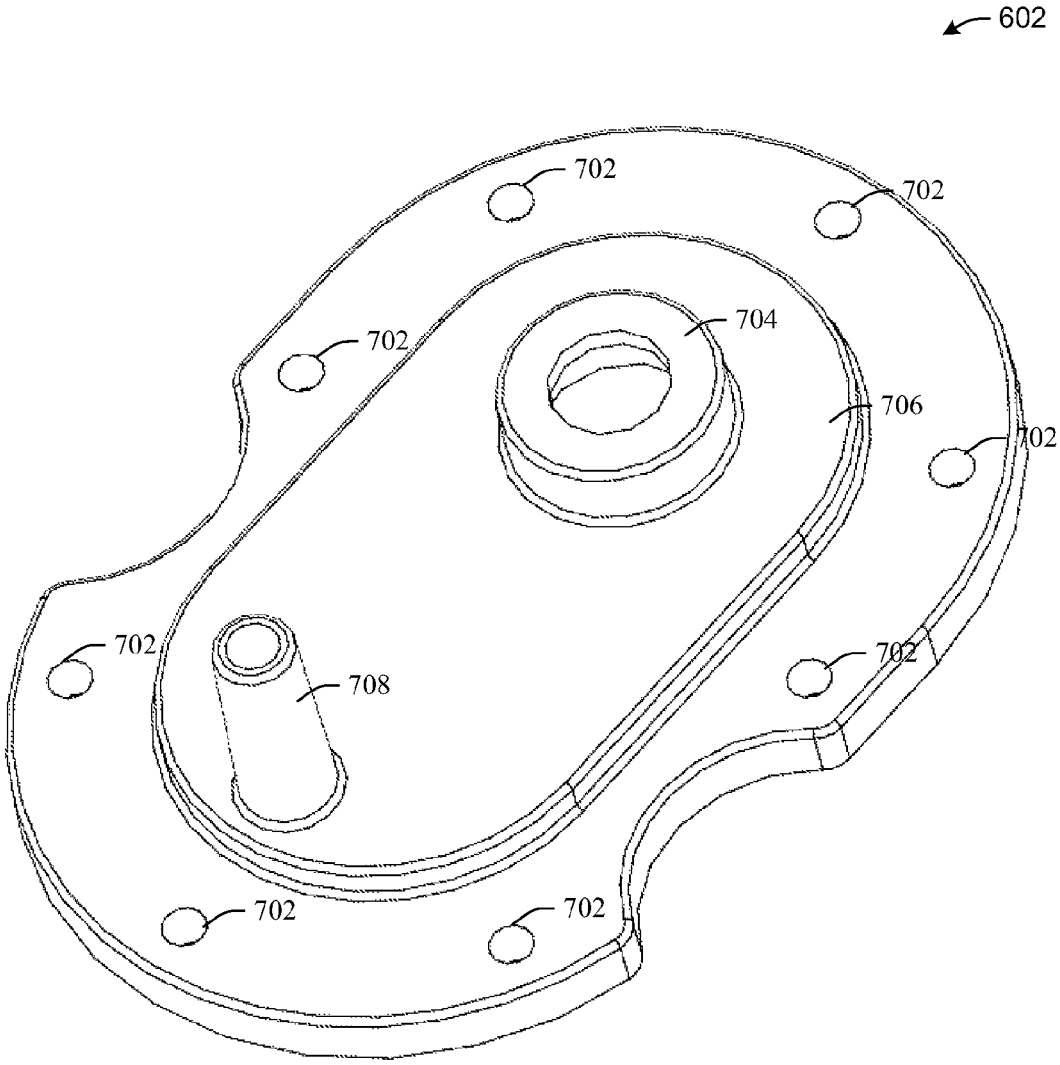
FIG. 7 illustrates an external top view of an example housing portion in accordance with an aspect of the innovation.

FIG. 7 illustrates a perspective top (or outside) view of housing portion 602. In one aspect, the housing portion(s) 602 (and 604) is molded from plastic or other suitable composite. However, it is to be appreciated that most any suitably rigid material can be employed in alternative aspects. As shown, this housing portion can include a plurality (e.g., eight (8)) of attachment holes or apertures which facilitate the housing 602 to be mated or fixedly attached to housing portion 604. Further, the housing portion 602 can include a raised cylindrical portion that is capable of housing spacer or cup seal 610. As described, this seal 610, together with the molded raised portion 704 of housing 602, facilitates alignment of one of the two gears within the pump 500.

Raised portion 706 produces a cavity within the pump housing when mated to the other housing portion 604. As described supra and in more detail infra, the raised portion is designed to allow blow-by around the gears so as to enhance operation of pump 500 in sprayer applications. Support 708 is provided to facilitate attachment of the pump 500 in an operating configuration, for example, to frame 20, gearbox 30 or some other appropriate location. While a specific support 708 is illustrated, it is to be appreciated that most any support can be employed without departing from the spirit and/or scope of the innovation.

Figure 8:
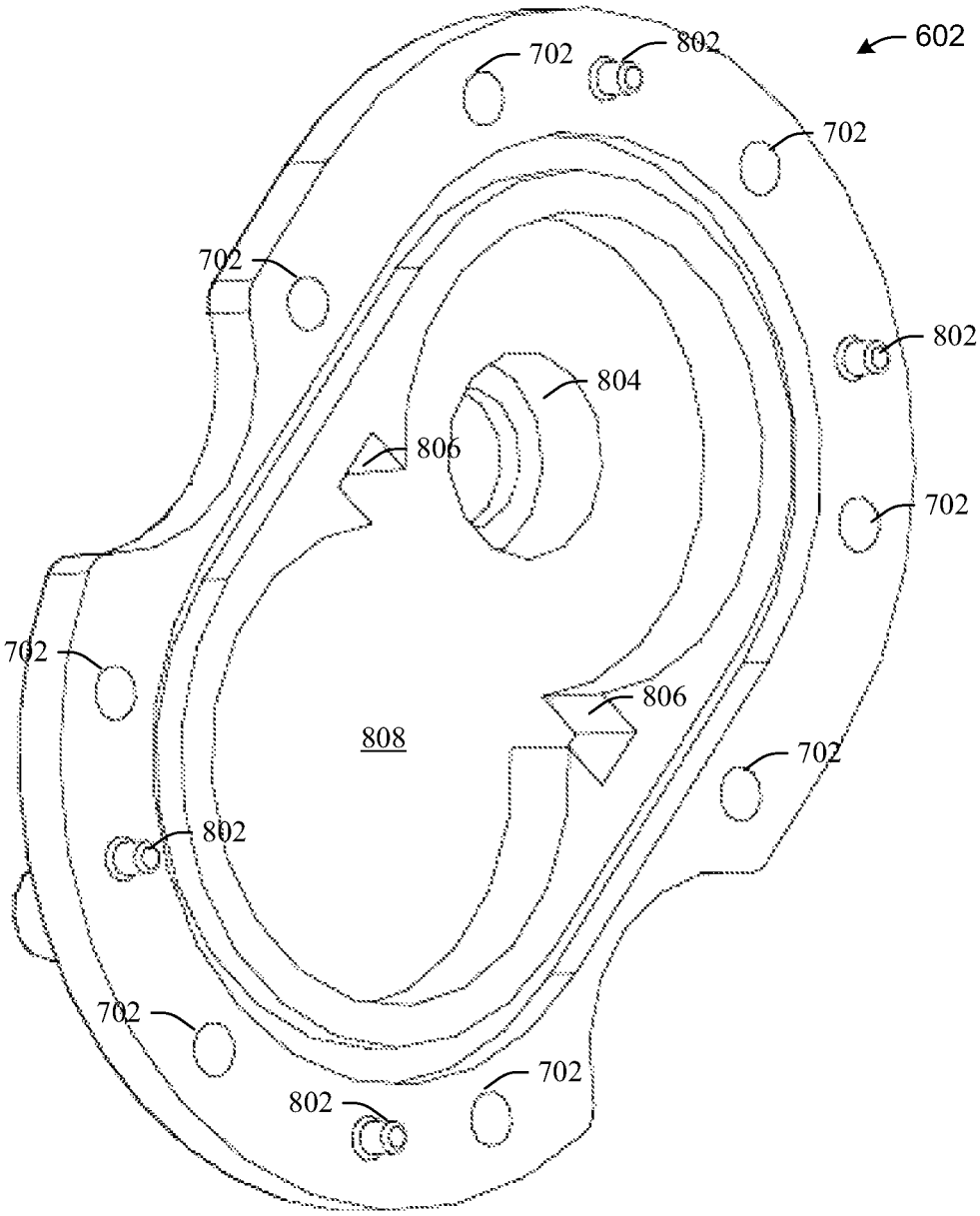
FIG. 8 illustrates an internal perspective view of the example housing portion of FIG. 7.

FIG. 8 illustrates an interior view of housing portion 602. In this embodiment, a plurality of alignment pins 802 is provided to facilitate proper alignment to housing portion 604. While male pins 802 are illustrated in FIG. 8, it is to be understood that alternative alignment means (e.g., grooves, indentations, . . . ) can be employed without departing from the scope of the innovation. Still further, it is to be understood that alignment means is optional in that other aspects can be employed without any such alignment means 802.

Cavity 804 is opposite of area 704 of FIG. 7 and assists in alignment of one of the two gears within the pump 500. As shown in FIG. 6, cup seal 610 is placed within the cavity 804 and accepts the shaft of gear 606. Fluid collection areas 806 are in communication with fluid inlet and outlet areas upon the mating housing portion 602. This mated area will be shown in and described with reference to FIGS. 9 and 10 that follow. Gear cavity 808 provides for an area to house gears 606, 608. The depth of the gear cavity 808 is designed to be sufficiently wider or deeper than the cross-sectional measurement of the gears 606, 608. This additional depth enables blow-by whereas liquid can be captured within or emptied from the gullet of engaged gears via blow-by from either face of the gears effectively re-circulating the liquid within the pump 500.

Figure 9:
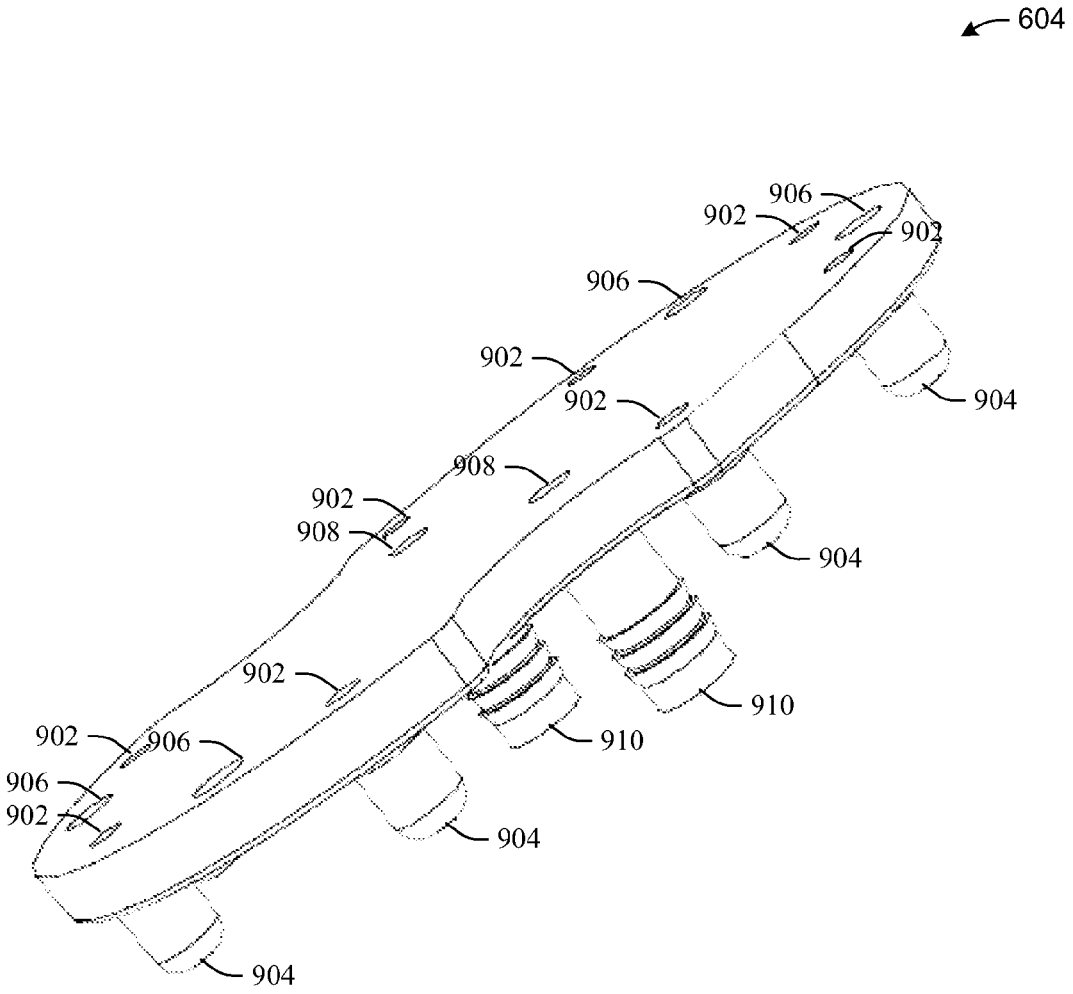
FIG. 9 illustrates a perspective view of an example housing portion in accordance with an aspect of the innovation.

FIG. 9 shows a perspective view of housing portion 604 in accordance with an aspect of the innovation. As shown, the interior face of the housing portion 604 includes a plurality of holes 902 that align with the holes 702 of the previously described housing portion 602. Consistent with each of the holes 902, attachment retention means 904 can be, for example, a cylindrical or conical molding configured to accept a bolt, screw or the like. As will be understood, when the two housing portions 602, 604 are mated together face-to-face, a fastening means (e.g., screw, clip, pin) can be inserted into holes 702, through holes 902 and into retention means 904. While the use of a screw or a bolt is described herein, it is to be understood that other means of locking or fixedly fastening the portions together 602, 604 can be employed without departing from the spirit and/or scope of the innovation and claims appended hereto.

Guide holes 906 accept the pins 802 of FIG. 8 to facilitate proper alignment of the housing portions (602, 604). During assembly, the male pins 802 are placed into the female guide holes 906 to align the housing portions (602, 604). Thereafter, retaining means (e.g., bolts, screws) can be tightened into, for example, a threaded receptacle 904.

Openings 908 and connections 910 illustrate an inlet and outlet of the pump 500. It is to be understood that the gear pump 500 is capable of working in reverse, therefore, either of the openings 908 and connections 910 can be an inlet or outlet as appropriate. With reference again to FIG. 2, hoses 52 and 54 can be fixed to the connections 910 in order to provide fluid to and accept discharge from the pump 500.

Figure 10:
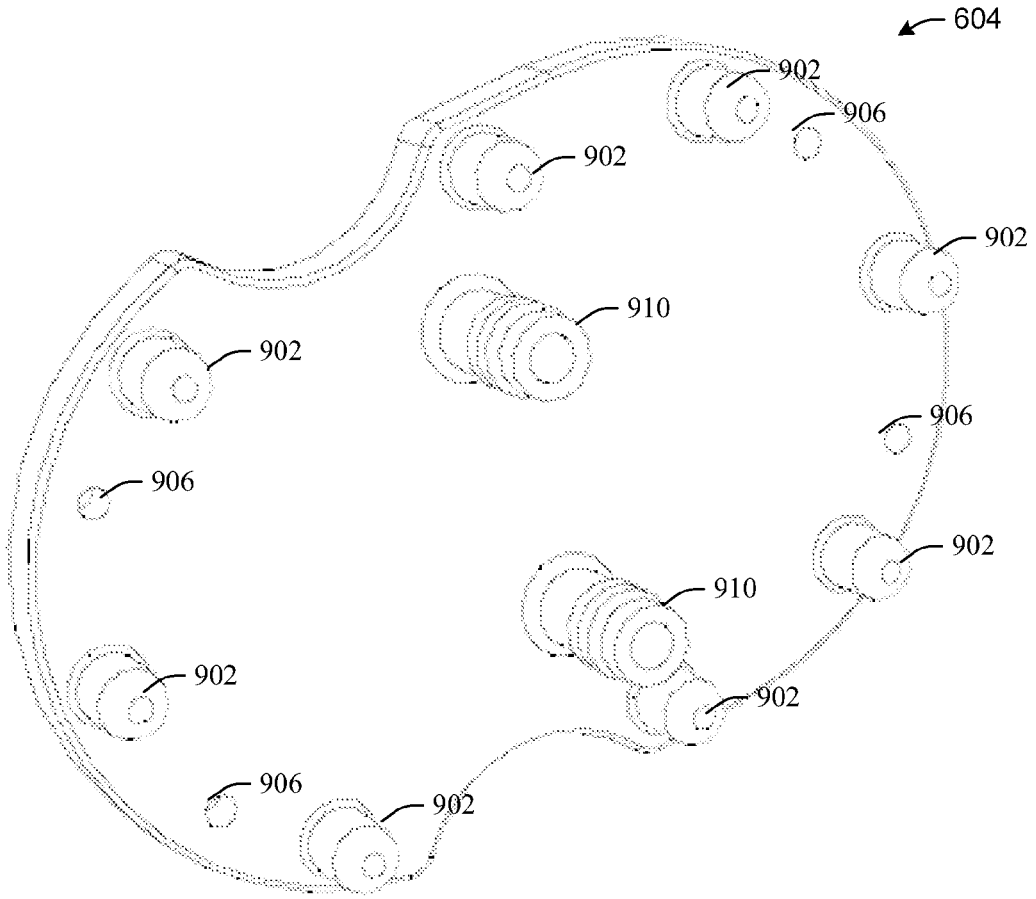
FIG. 10 illustrates an external view of the example housing portion of FIG. 9.

FIG. 10 is included to add perspective to the placement of components of housing portion 604. In particular, FIG. 10 illustrates an outside view of the housing portion 602. As described above, inlet and outlet connections 910 are provided to facilitate movement of liquid in and out of the pump 500 respectively.

Figure 11:
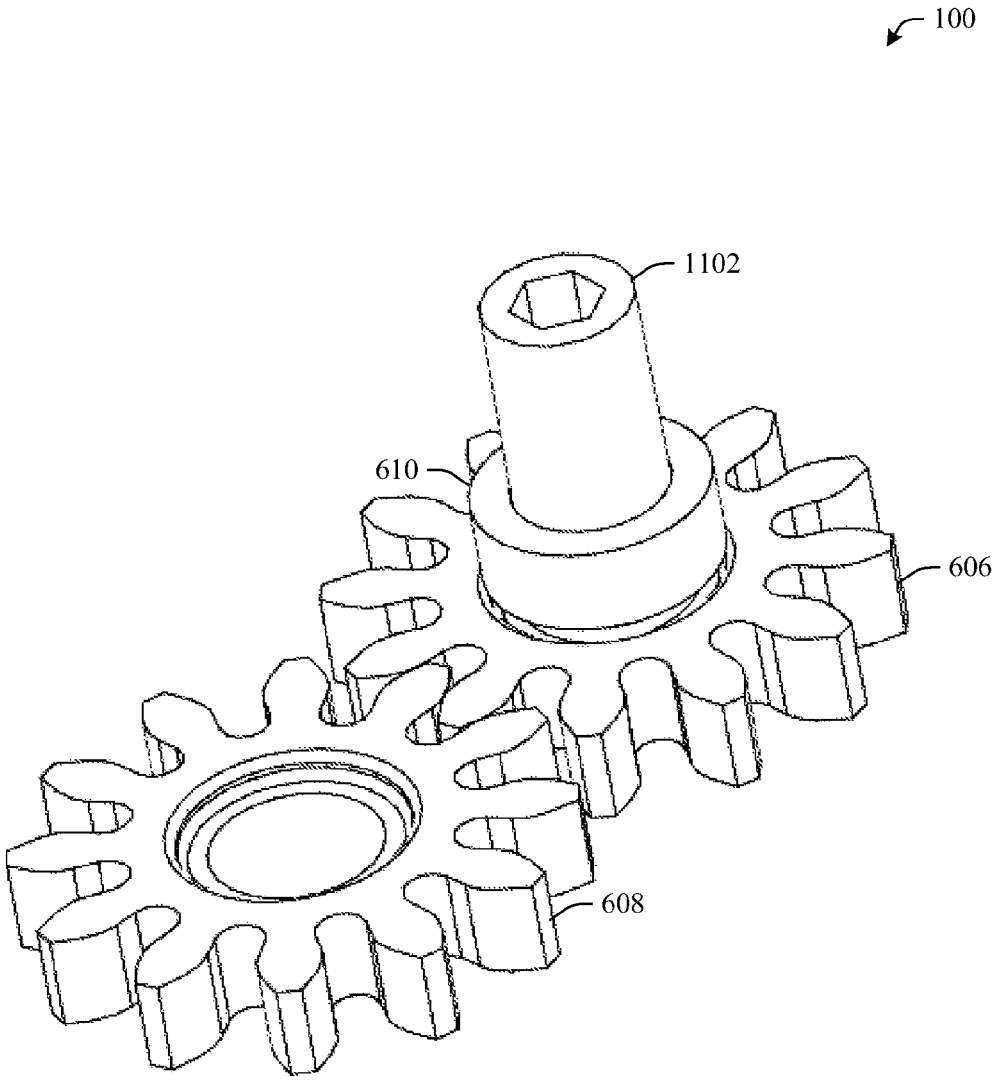
FIG. 11 illustrates an example gear pump gearing assembly in accordance with an aspect of the innovation.

Referring now to FIG. 11, example gearing is illustrated that can be employed (or enclosed) within the previously described housing portions (602, 604). As shown, the gears 606 and 608 can communicatively engage to transmit motion from a wheel (or axle) to ultimately pump liquid within (or from) a sprayer (e.g. sprayer 10 of FIG. 1). As illustrated, in this example, spur gears (606, 608) are employed within the pump 500. While specific tooth profiles are shown, it is to be understood that alternative designs can employ disparate profiles while retaining the features, functions and benefits of the gear pump design. Similarly, it is to be appreciated that the gear tooth ratio can be adjusted in accordance with a desired rate of flow as well as resistance.

Shaft 1102 can be operatively connected to the gearing within case 30 as described in detail supra. In other aspects, shaft 1102 can be positioned in direct communication with the axle of the spreader. It will be understood that, the placement of the pump 500 can be a design choice based upon a number of factors including, but not limited to, cost, resistance, dispersion/spray rate, etc. In manufacture, because the gears (606, 608) can be injection- or roto-molded from plastic (or other suitably rigid material), the shaft 1102 can be directly molded onto gear 606. In other aspects, the shaft 1102 can be a separate molding and assembled onto or fixedly attached to gear 606 as shown.

Figure 12:
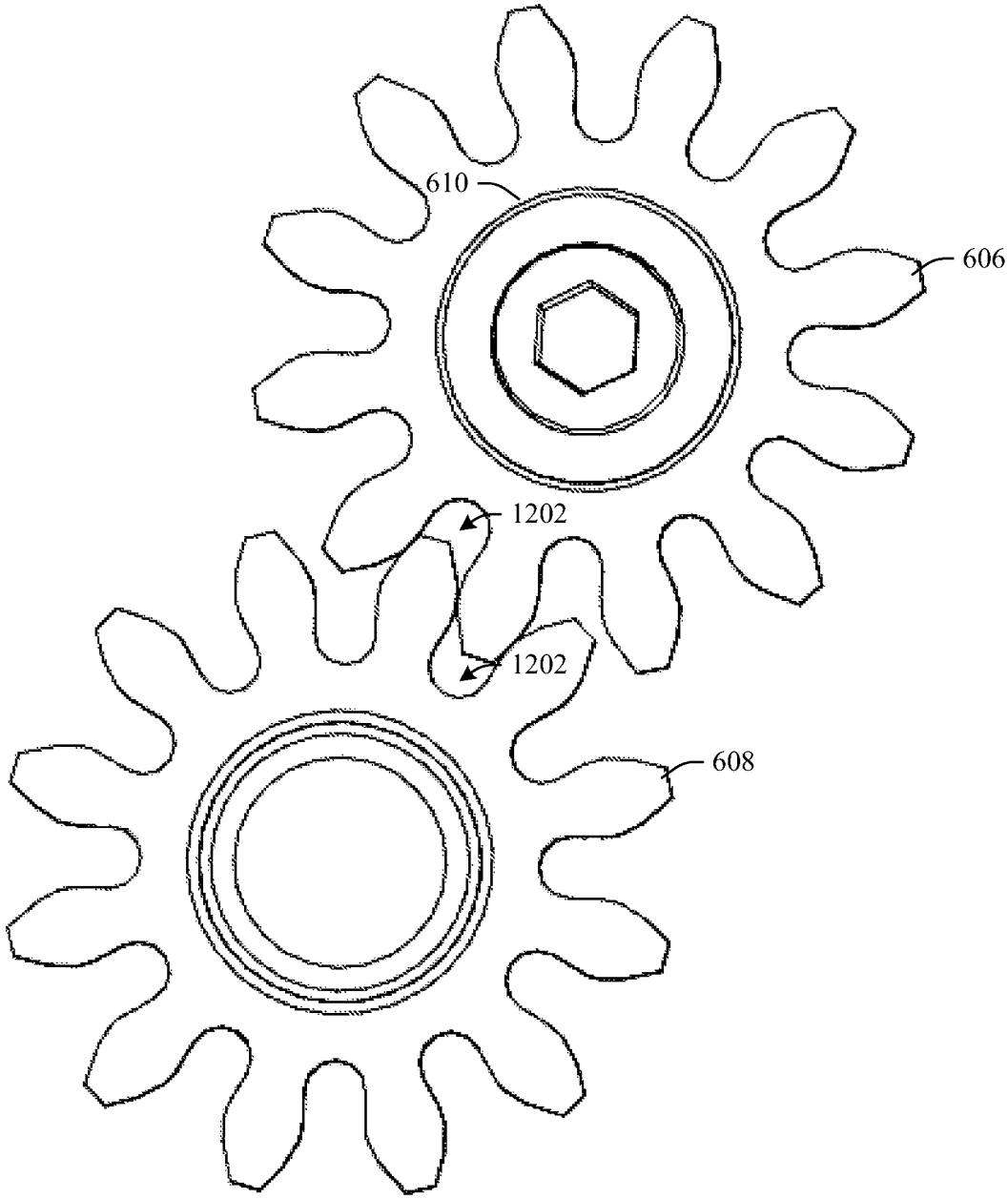
FIG. 12 illustrates a top view of the example gear pump gearing assembly of FIG. 11.

One key feature of the gearing within the example pump 500 is the over-capacity gullet size 1202 as shown in FIG. 12. As illustrated, the tooth profile of each gear 606, 608 is specifically designed to produce a gullet 1202 capable of taking advantage of the accompanying design feature of permissive blow-by. In other words, because the gears 606, 608 are free floating within a cavity (808 of FIG. 8) which is of greater depth than the gears themselves, liquid is able to enter and/or exit, aka blow-by, the face of the gears from or back into the cavity 808. In conventional gear pumps, liquid it trapped within a narrowly designed gullet thereby increasing pressure and efficiency of the pump. Here, because high pressure and efficiency need not be optimized, blow-by is permitted which enhances performance of the pump 500, for example, in walk-behind sprayer implementations.

It is important to note that both gears 606, 608 can be free floating and not fixedly attached to either housing portion 602, 604. Rather, the feature of free-floating gears (e.g., no center pins) contributes to the ability to permit blow-by. It is to be understood that the gears (602, 604) are lined-up or orientated by the tips of the teeth within cavity 808.

In accordance with the example gear pump 500, during rotation, just prior to traversal of the centerline of a tooth of one gear (e.g., 606) engaging with a tooth of the other gear (e.g., 608), liquid enters the gullet 1202. As both walls of the teeth are in contact, the liquid is trapped in the gullet 1202. It is to be understood that, due to the "over-capacity" design of the gullet, the gullet does not completely fill due to rotational engagement. Rather, because of the difference in depth of the cavity 808 compared to the gears 606, 608, additional liquid is permitted to fill and escape the gullet area (e.g., blow-by). Continuing with rotation, past the centerline, liquid is released into the outlet channel as shown above.

In other words, one key feature of the innovation is the enlarged or over-capacity gullet size in relation to the tooth size. As shown, the gullet 1202 can be 25%-33% of the size of the tooth in some aspects. It is to be appreciated that conventional gear pump designs consider this oversized gullet insufficient and non-productive as it was not possible to fill the gullet with liquid. In accordance with the innovation, the gullet 1202 is specifically designed over its capacity as would be deemed under conventional standards. However, the additional clearance between the cavity 808 and the face of the gears 606, 608 enables the gullet to partially fill from one face and empty from the other (e.g., blow-by). It will be appreciated that, in sprayer applications, the flow need not be at extremely high pressures but, rather, good flow is desired. Here, this design which enables fluid to blow-by from one face to the other, in conjunction with the over-capacity gullet, can accomplish sufficient flow.

The innovation employs the gullet size to adjust the volume of flow as well as the pressure of the system. Contrary to conventional gear pumps where an increased rate of rotation created more pressure and thus, more flow—the innovation's blow-by feature is capable of maintaining a substantially consistent rate of flow as a function of variable rotations. As will be understood, this is especially helpful in walk-behind sprayer applications.

Because conventional gear pumps are efficient in that they do not permit blow-by, the distribution rate can vary greatly for a nominal increase in gait. For example, it may take 500 feet with a conventional sprayer to disperse three gallons of fluid walking at a pace of two mph. Using the same conventional sprayer with a non-blow-by pump, the same three gallons of fluid may be dispersed in only 300 feet at two and one-half mph. It will be appreciated that this slight variation of walking pace can result in over-treatment, under-treatment or waste.

In accordance with the subject pump 500 having an over-capacity gullet size and orientation that permits blow-by, walking speed is much less important in maintaining consistent application. For example, studies have shown that three gallons of fluid can be distributed in 500 feet at two mph. While the pace is increased to two and one-half mph, the distribution of the same three gallons of liquid is only decreased to 450 feet. It will be appreciated that the combination of the increased gullet size together with the blow-by feature, flow rate of the gear pump 500 can be more consistent than that of conventional pump designs.

In summary, as stated above, the relationship of the tooth to gullet size can be combined with blow-by to enhance flow-rate consistency of the pump 500. In one example, the difference between the gear faces and the housing portion cavity walls can be configured to sufficiently permit fluid to escape and enter the gullet on either face. In operation, the fluid that is blown-by the gear faces (e.g., in/out of the gullet) is not wasted. This fluid is merely circulated into the housing and back into the pool of liquid.

Figure 13:
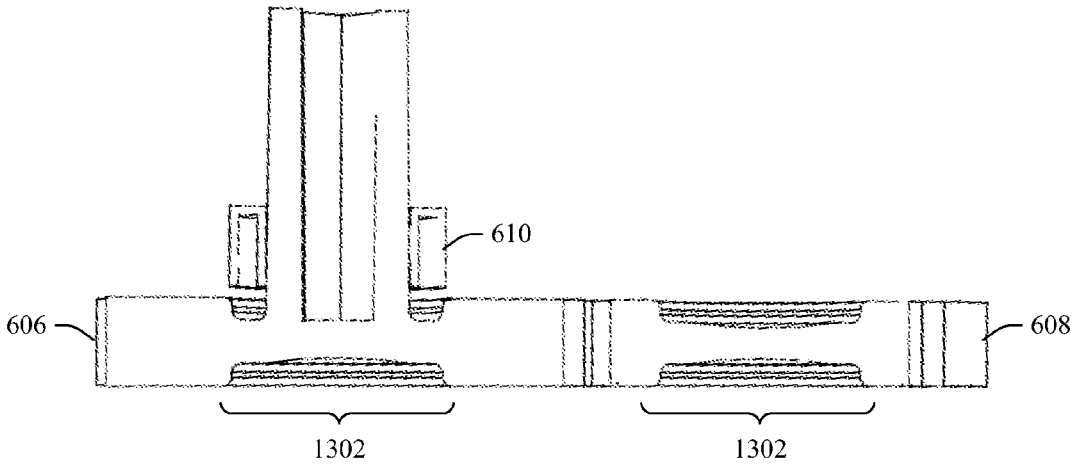
FIG. 13 illustrates a cross-sectional view of the example gear pump gearing assembly of FIG. 11.

FIG. 13 illustrates a cross-sectional view of gears 606, 608 and seal 610. It will be understood that, while the gear pump gears (606, 608) can be manufactured of plastic, they can be prone to shrinkage and warping effects. As illustrated in FIG. 13, the center dish-like portion of each gear can have a specially designed profile 1302 capable of absorbing shrinkage- and warp-effects. In other words, because the center dish-like section is designed with the thinnest area in the center, cooling will begin in the center and traverse outward to the teeth. As will be understood, this order of cooling will enable the center section 1302 to function somewhat like an accordion thereby absorbing tension. While tension is absorbed within the center portion, the outward section (e.g., teeth) of the gears 606, 608 can be alleviated of shrinkage or warping effects. This feature can enhance performance and longevity of the gear pump 500 in heat-prone applications.

Figure 14:
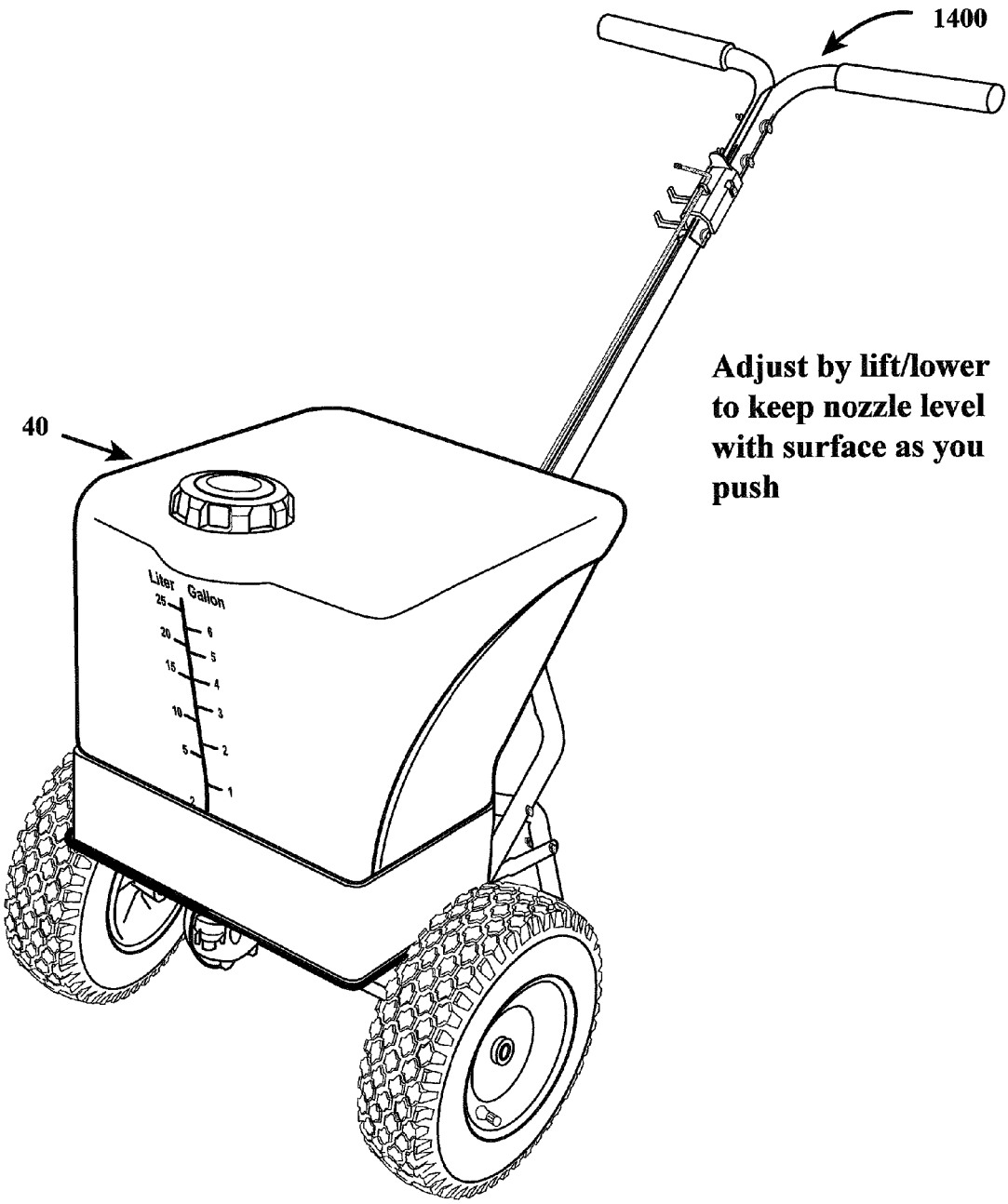
FIG. 14 illustrates a perspective view of an example sprayer in accordance with an aspect of the innovation.
Figure 15:
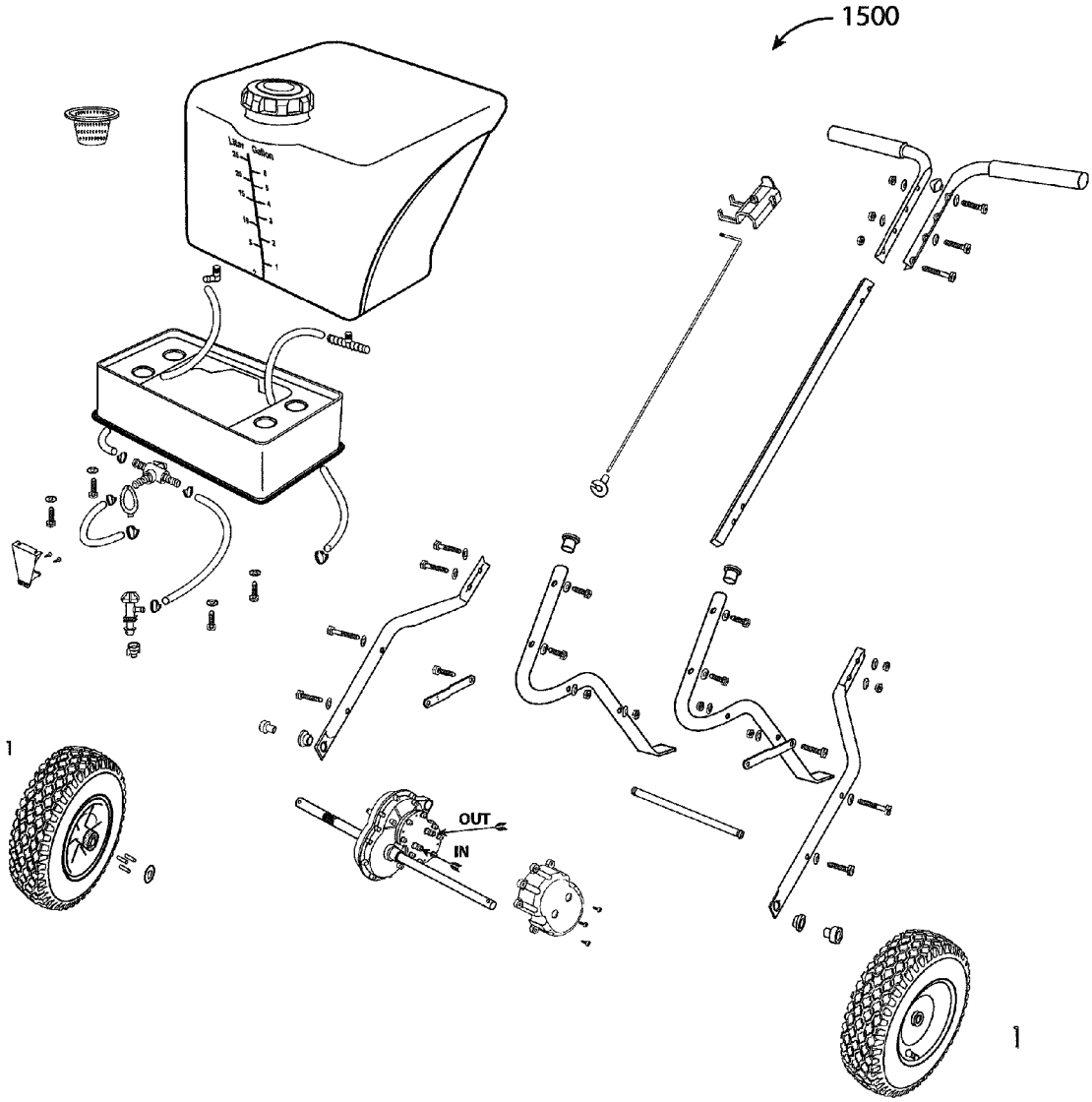
FIG. 15 illustrates an exploded view of an example sprayer in accordance with an aspect of the innovation.

FIGS. 14 and 15 are provided to illustrate yet other aspects of the innovation capable of employing the features of fluid recirculation (e.g., transport mode), drive gearing, blow-by capable gear pump, among others. As shown in FIG. 14, and described in detail with regard to FIG. 4 supra, a contoured vessel 40 can be employed to enhance the ability to fill and empty the vessel. In the aspect of sprayer 1400, a screw-type cap can be employed on vessel 40. It is to be understood that most any capping device can be employed in alternative aspects.

FIG. 15 illustrates an exploded parts or kit view of a sprayer 1400. While this illustration is detailed of but one example, it is intended to provide context to the overall assembly of the sprayer 1400 and not to limit the innovation in any manner. It is to be understood that aspects exist that exclude some of the components as well as others that include additional components as shown in FIG. 15. These alternative aspects are to be considered within the scope of this specification and claims appended hereto.

Figure 16:
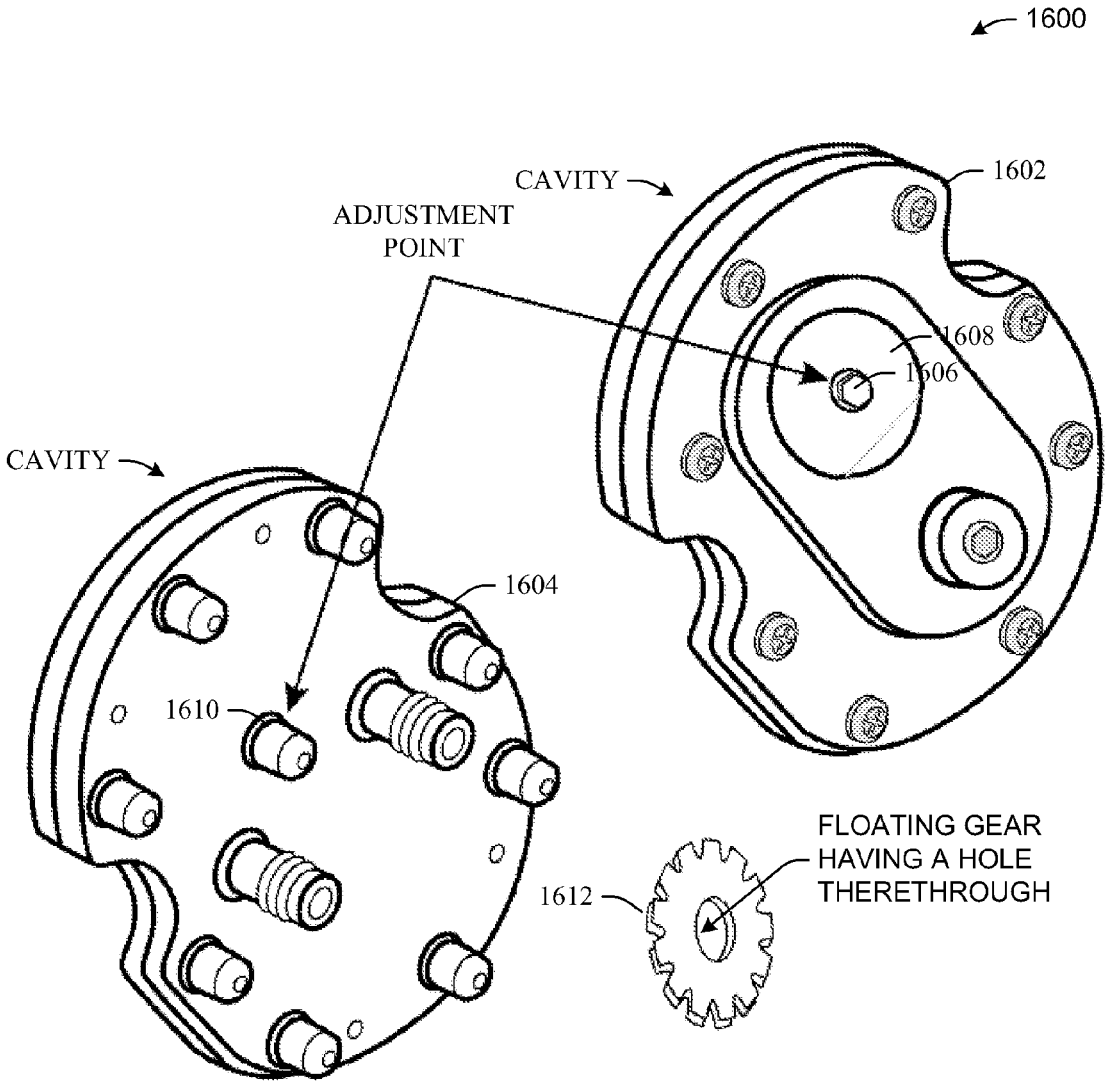
FIG. 16 illustrates an alternative pump design in accordance with aspects of the innovation.

Referring now to FIG. 16, an alternative design of a pump (e.g., pump 500 of FIG. 5) is shown. In particular, FIG. 16 illustrates an alternative housing design 1600 that is adjustable to regulate pump output as desired. Consistent with FIG. 5, the example housing 1600 can include two portions, e.g., halves, 1602 and 1604 that mate to form a cavity whereby gearing mechanisms and liquid can be disposed.

A first housing portion 1602 can be equipped with a bolt 1606 and washer 1608 assembly that penetrates the case of the housing portion 1602. A second housing portion 1604 is equipped with a receiver 1610 that accepts a threaded section of bolt 1608. To accommodate the adjustment means (e.g., 1606, 1608, 1610) that penetrates the cavity, a floating gear 1612 is provided having a hole or cutout that permits the bolt 1606 to pass therethrough. In this example, the opening or hole in floating gear 1612 is specifically designed oversized in relation to diameter of the shaft of bolt 1602. Thus, floating characteristics of the gear 1612 are consistent to that of gearing mechanisms described in FIG. 5 supra. It will be appreciated that, while the housing portions 1602 and 1604 are manufactured of plastic or other suitably rigid material, the surfaces of the housing can flex thereby affecting pressure cavity and ultimately output of the pump.

In the example of FIG. 16, housing portion 1602 can be equipped with a washer or disc that, when connected to the other housing portion 1604 can provide adjustable rigidity (or depth restrictor) to the housing portion(s) 1602, 1604. In operation, the bolt 1606 (e.g., ½ inch diameter×2½ length bolt) can be inserted through gear 1612 and into receiver 1610. As the threaded portion of the bolt 1606 is tightened (or loosened), the size and expansion capabilities of the cavity can be controlled thereby regulating pump output.

In addition to regulating overall output of the pump, it will be appreciated that this flex adjustment means can regulate consistency of output by resisting expansion and/or contraction of the housing portion (1602, 1604). It will be understood and appreciated that output of the pump can be affected by this expansion and/or contraction of the cavity, e.g., in response to liquid pressure. Thus, by incorporating the adjustment means, rigidity of the housing can be controlled thereby controlling pump output as desired.

It is to be understood that FIG. 16 illustrates one aspect of a rigidity adjustment means. Other alternative aspects of adjusting or controlling housing expansion/contraction can be employed in accordance with the features, functions and benefits of the innovation. For example, a spring-loaded pressure clamp(s), snap- or bolt-on bracing mechanisms, or the like can be employed in alternative designs. Additionally, by design, a bolt or other means (e.g., friction pin, cotter pin, etc.) can be employed to restrict the flex or expansion of the pump housing. These alternative designs are to be included within the scope of this disclosure and claims appended hereto. Moreover, it is to be understood and appreciated that, in aspects, the washer can be bent downwardly along the edge. In other words, a portion of the washer can be bent toward the pump housing (e.g., in a convex manner) so as to enhance flex control of the pump housing. Further, a detent can be downwardly struck at the washer periphery, for example, opposite the aforementioned bent portion. In aspects, the bottom edge of the bent portion abuts the surface of the gear housing while the under portion of the struck detent rests between a number of (e.g., two of four) raised bosses (or other treatment) molded as part of the gear housing. It will be appreciated that these details can control where, upon the housing, pressure is applied when the bolt is tightened.

Figure 17:
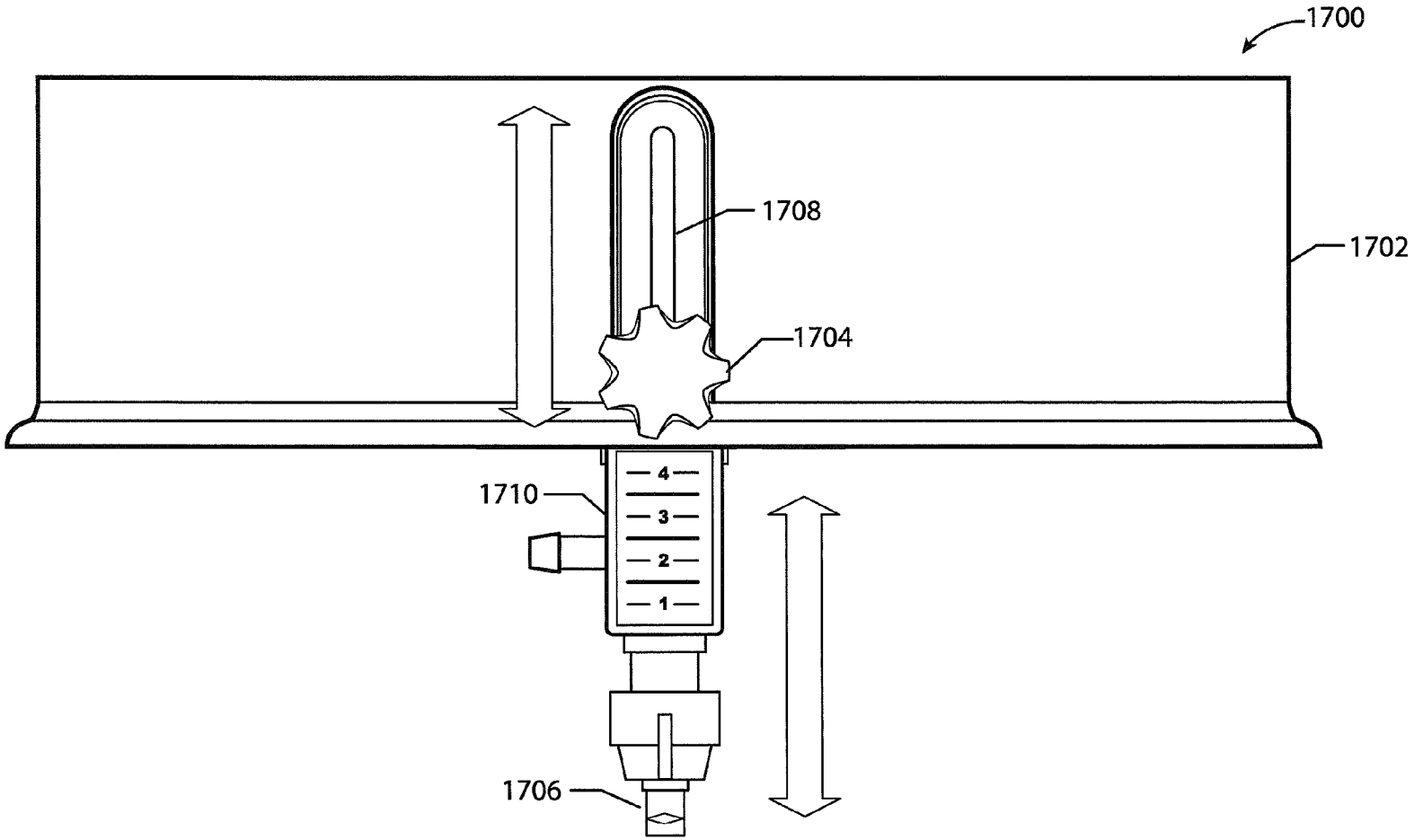
FIG. 17 illustrates an example adjustable nozzle design in accordance with an aspect of the innovation.

Referring now to FIG. 17, an alternative aspect 1700 of the innovation is shown. In particular, as illustrated, the aspect 1700 is a sprayer that employs an adjustable nozzle means. The alternative aspect 1700 can employ a tank or vessel 1702 that is capable of housing liquid. Additionally, item 1702 of FIG. 17 can be representative of a cover that shrouds or encompasses a liquid storage vessel (e.g., 1702).

An adjustment means 1704 can be employed to effect or enable movement of a spray nozzle 1706. In operation, the knob 1704 can be loosened to enable travel about a guide, track or groove 1708. A scale 1710 can be used to determine a desired height (or spray pattern, etc.). Thus, the scale section 1710 can travel into and out of the housing or shroud 1702. While specific orientations and representations of the items of FIG. 17 are shown, it is to be understood that alternatives can be employed without departing from the spirit and/or scope of the innovation and claims appended hereto. For example, a different configuration of an adjustment means 1704 can be employed, e.g., locking knob, pin, slotted, etc. These, and other, alternatives are to be included within the scope of this disclosure and claims appended hereto.

By vertically adjusting the nozzle (closer and farther from ground level), the spray coverage area will be decreased and/or increased respectively. As will be understood, this adjustment can be used to assist in tight areas, around edges, etc. so as to control waste and desired coverage area. Additionally, vertical adjustment will increase and decrease concentration rate as the nozzle is moved closer or farther from ground level respectively. It will be appreciated that, while raising and/or lowering does not actually change concentration rate, the effective concentration rate upon the ground is increased or decreased based upon movement of the nozzle.

If desired, a different nozzle can be applied to compensate for the change in effective concentration. For instance, a fine or course nozzle can be used as desired and/or appropriate. It will be appreciated that different nozzles have different atomization patterns and volumes. Thus, to maintain a desired concentration and pattern coverage, a user can change out the nozzle in connection with raising and/or lowering nozzle height.

Figure 18:
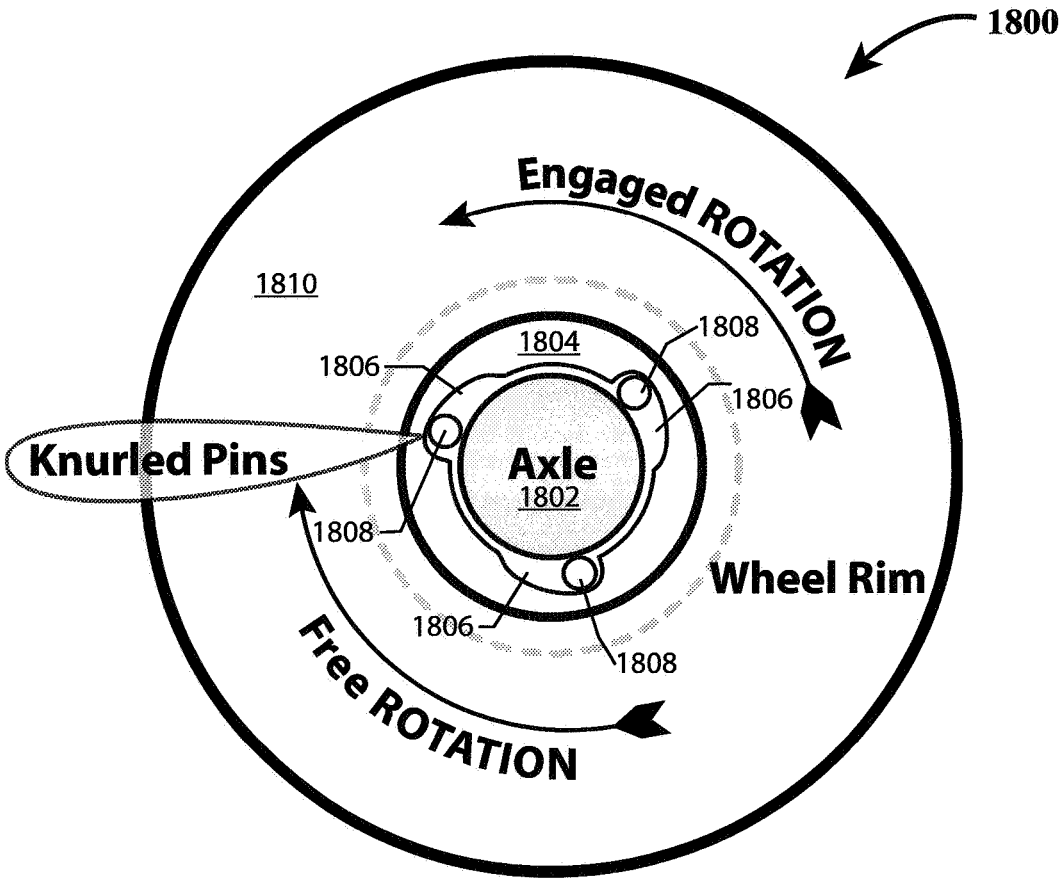
FIG. 18 illustrates an example hub design in accordance with aspects of the innovation.

Turning now to FIG. 18, a cross-sectional view of an example wheel hub assembly is illustrated. In particular, the hub assembly 1800 design illustrated in FIG. 18 enables free and/or engaged rotation in as shown by the rotational arrows in the figure. As shown, generally, hub assembly 1802 includes an axle 1802 encased by a hub housing 1804 having ramp-like or inclined cutouts 1806 machined therein. While three separate cut-out areas are shown, it is to be understood that additional (or fewer) cut-out sections can be employed without departing from the spirit and/or scope of this specification and claims appended hereto.

In operation, in the "free rotation" direction, pins 1808 (e.g., knurled or dowel pins) travel freely about the axle 1802. In the opposite or "engaged rotation" direction, each pin 1808 catches within the contour of each cutout 1806 thereby engaging the hub 1804. As described herein, it will be understood that rotation of the engaged hub 1804 effects pump rotation and liquid discharge.

What has been described above includes examples of the innovation. It is, of course, not possible to describe every conceivable combination of components for purposes of describing the subject innovation, but one of ordinary skill in the art may recognize that many further combinations and permutations of the innovation are possible. Accordingly, the innovation is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A motion-activated sprayer apparatus, comprising:

a vessel that holds a volume of liquid;

at least two passageways in fluid communication with the vessel;

a pump in fluid communication with one of the at least two passageways of the vessel and driven as a function of rotation of at least one wheel of the motion-activated sprayer apparatus, the pump having a first housing and a second housing joined with a plurality of fasteners around a perimeter of the first and second housing forming a cavity therein; and a housing adjustor that controls flex in the first or second housing thereby regulating an output of the pump, the housing adjustor including an adjustment mechanism, a washer and a receiver portion, wherein the adjustment mechanism passes through the washer and the second housing portion and threads into the receiver portion molded into the first housing portion; and a vertically adjustable nozzle assembly that receives fluid from the other of the two passageways and discharges fluid as a function of a desired spray pattern coverage area.

2. The apparatus of claim 1, the vertically adjustable nozzle assembly comprises an adjustment means that travels within a guide, wherein the travel effects vertical adjustment of the distribution means in relation to ground level.

3. The apparatus of claim 1, further comprising a scale that identifies a concentration setting as a function of distribution means adjustment.

4. The apparatus of claim 1, motion-activated sprayer is a walk-behind sprayer that comprises an engagement hub assembly that engages in one rotational direction and is free in the other rotational direction.

5. The apparatus of claim 4, wherein the engagement hub assembly encases an axle and employs a plurality of ramp-like cutouts and a plurality of pins to enable engaged and free rotation, and wherein each of the ramp-like cutouts include a tapered end and a vertically shaped end, wherein at least one of the pins is positioned within the vertically shaped end in the engaged rotation direction.

6. The apparatus of claim 5, wherein the hub assembly comprises at least three ramp-like cutouts.

7. The apparatus of claim 1, wherein the pump is a drill pump.

8. The apparatus of claim 1, wherein the pump is a gear pump.

9. The apparatus of claim 8, wherein the gear pump comprises at least two spur gears encased within an adjustable housing and adapted to transfer fluid.

10. The apparatus of claim 9, wherein each of the spur gears comprises a plurality of teeth configured to engage creating an over-capacity gullet, wherein the over-capacity gullet is incapable of filling based solely upon gear rotation.

11. The apparatus of claim 10, wherein the over-sized gullet can be filled and emptied via blow-by fluid, wherein the blow-by fluid is facilitated by a gap between each of the spur gears and the housing.

12. The apparatus of claim 11, wherein the gap is at least 2/1000 of an inch.

13. A liquid dispensing apparatus comprising:

a vessel configured to hold a volume of liquid;

a spray nozzle in fluid communication with the vessel via a first passageway;

a pump providing a fluid connection between the vessel and the spray nozzle and configured to pump the liquid out of the vessel and through the spray nozzle upon rotation of at least one wheel, the pump including:

a first housing portion, a second housing portion that mates with the first housing portion thereby forming a cavity inside the pump, and a housing adjustor connected to the first housing portion and the second housing portion such that when activated flexes the first housing portion or the second housing portion, which expands and contracts the cavity thereby adjusting a volume of the cavity and regulating an output of the pump, the housing adjustor including an adjustment mechanism, a washer and a receiver portion, wherein the adjustment mechanism passes through the washer and the second housing portion and threads into the receiver portion molded into the first housing portion.

14. The liquid dispensing apparatus of claim 13, wherein the pump further includes:

a first spur gear disposed within the cavity, the first spur gear having a plurality of teeth and a gullet formed between adjacent teeth; and a second spur gear disposed within the cavity that engages the first spur gear, the second spur gear having a plurality of teeth and a gullet formed between adjacent teeth, wherein at least one of the first spur gear and the second spur gear is free-floating.

15. The liquid dispensing apparatus of claim 14, wherein upon engagement of the first spur gear and the second spur gear, the teeth from each respective spur gear extend into corresponding gullets of the other spur gear such that a gap forms between a top of the teeth and a bottom of the corresponding gullet.

16. The liquid dispensing apparatus of claim 15, wherein the gullets are 25-33% larger than the teeth.

17. The liquid dispensing apparatus of claim 13 further comprising a valve and a second passageway in fluid communication with the vessel that directs the liquid back into the vessel, wherein the valve redirects the liquid between the first passageway and the second passageway.

18. The liquid dispensing apparatus of claim 13 further comprising an adjustment means that travels within a guide thereby vertically adjusting a position of the spray nozzle relative to the ground.

19. The liquid dispensing apparatus of claim 13 further comprising a wheel hub assembly that encases an axle and employs a plurality of ramp-like cutouts and a plurality of pins to enable engaged and free rotation, and wherein each of the ramp-like cutouts includes a tapered end and a vertically shaped end, wherein at least one of the pins is positioned within the vertically shaped end in the engaged rotation direction.

* * * * *